United States Patent [19]

Yasunobu et al.

[11] Patent Number: 4,717,029

[45] Date of Patent: Jan. 5, 1988

[54] CRANE CONTROL METHOD

[75] Inventors: Seiji Yasunobu, Yokohama; Shoji Miyamoto, Kawasaki, both of Japan

[73] Assignee: Hitachi, Ltd., Tokyo, Japan

[21] Appl. No.: 895,303

[22] Filed: Aug. 11, 1986

[30] Foreign Application Priority Data

Aug. 16, 1985 [JP] Japan ..... 60-180249

[51] Int. Cl.[4] ..... B66C 19/00

[52] U.S. Cl. ..... 212/132; 212/147; 212/270

[58] Field of Search ..... 212/132, 146, 147, 159, 212/161, 205, 270

[56] References Cited

U.S. PATENT DOCUMENTS

| | | | |
|---|---|---|---|
| 3,517,830 | 6/1970 | Virkkala | 212/146 |
| 3,921,818 | 11/1975 | Yamagishi | 212/161 |
| 4,512,711 | 4/1985 | Ling et al. | 212/147 |
| 4,603,783 | 8/1986 | Tax et al. | 212/147 |

FOREIGN PATENT DOCUMENTS

| | | | |
|---|---|---|---|
| 58-95094 | 6/1983 | Japan | 212/147 |
| 58-95093 | 6/1983 | Japan | 212/147 |

*Primary Examiner*—Jeffrey V. Nase
*Assistant Examiner*—Stephen P. Avila
*Attorney, Agent, or Firm*—Antonelli, Terry & Wands

[57] ABSTRACT

In a control method of a crane in which a parcel suspended by a rope is laterally transported by a trolley, the accelerating time and decelerating time of the trolley are obtained on the basis of the mass of trolley, mass of suspended parcel including a suspending device, and rope length, and when the trolley is started, the accelerating force which is necessary to allow the velocity of trolley to become an objective velocity for the accelerating time is instructed, and after this accelerating time has elapsed, the trolley is allowed to uniformly run at the objective velocity. During the constant speed running, the stop position of the trolley is predicted on the basis of the decelerating time. When the trolley reaches the start position of the decelerating operation such that the trolley can be stopped at the objective position, the decelerating force which is necessary to reduce the trolley velocity to zero for the decelerating time is instructed.

4 Claims, 11 Drawing Figures

0
15
30
Ls
ℓ (t) [m]

500
0
-500
Im (t) [A]

1.25
0
V (t) [m/s]
Vc 0.05
0
-0.05
θ (t) [RAD]
0
5
10
15
20
25
30
35
40
45
t [sec.]

CRANE CONTROL METHOD

BACKGROUND OF THE INVENTION

1. Field of the Invention

The present invention relates to a crane control system and, more particularly, to a crane control system fitted for shipping works at ports and the like which can convey suspended parcels to predetermined positions with little swinging motion.

2. Description of the Prior Art

Skilled techniques are needed to operate a crane such as, for example, a container crane in facilities at ports and the like in order to accurately hoist down the suspended parcels to the objective positions while minimizing the swinging motions of the suspended parcels. The experienced crane operators and engineers lack as compared with an increase in materials handling and transportation amounts of cargoes and the automatic control of cranes is more and more required.

Hitherto, as automatic crane control systems in which a crane is driven while the swinging motion of suspended parcels is suppressed, the following systems have been known.

The first system:

The system such that the swing angle of rope by which a parcel is suspended is detected and the rope is controlled in a feedback manner so as to reduce the swinging motion of the parcel is known. However, this system has the problem such that it is hard to put into practical use because of difficulty of detection of the swing angle.

The second system:

For example, as disclosed in JP-A-58-95094 or JP-A-58-95093, the swinging motion of the parcel suspended by the trolley is reduced by changing the velocity of trolley in accordance with a previously calculated objective velocity pattern. According to this system, it is necessary to give an enough tractive force of trolley in order to correct the difference between the actual trolley velocity and a desired velocity which is caused due to the swing of parcel or disturbances by the wind and the like. The trolley cannot be allowed to run to a desired position for the shortest time by making the most of the capability of the driving motor, so that there is the problem such that the cycle time is prolonged.

The third system:

For example, as disclosed in JP-A-55-130480, the acceleration and deceleration of trolley are controlled by only the starting torque when the trolley is started and by only the braking torque when the trolley is stopped, thereby preventing the swing of suspended parcel when the trolley enters the stationary velocity operation or stops at an objective position. In this case, the starting torque upon starting of the trolley is generated in the following manner. Namely, an accelerating operation period is obtained so as to be equalized with a natural period of a pendulum which is determined by the length of rope. An acceleration such that the velocity of trolley becomes an objective velocity (stationary operating velocity) when the trolley was accelerated to a predetermined degree for this accelerating period is obtained. The starting torque is generated so as to obtain this acceleration. When the trolley is stopped, a deceleration to stop the trolley is calculated from the rope length and stationary operating velocity and the braking torque corresponding to this deceleration is determined. Briefly speaking, the third system is realized under the conditions such that when the trolley is started or braked, it can run at a constant acceleration or deceleration without being influenced by the suspended parcel when this parcel is swung and returned. However, if the trolley is started by the actual crane when the suspended parcel is at rest, the inertia of the suspended parcel functions so as to obstruct the acceleration of the trolley until the swing angle of rope becomes the maximum value. Thereafter, when the parcel advances due to the pendulum motion, the parcel acts to facilitate the acceleration of trolley. According to the third system, to prevent the swing of parcel, the trolley needs to be accelerated (or decelerated) at a calculated fixed acceleration (or deceleration) irrespective of the above-mentioned functions of the suspended parcel. However, in the actual crane, it is difficult to realize such a velocity control of the trolley.

SUMMARY OF THE INVENTION

It is an object of the present invention to provide a crane control system in which suspended parcels can be transported with less swing and which can be easily realized.

Another object of the invention is to provide a crane control system in which suspended parcels can be transported with less swing and can be promptly hoisted down with less swing to an objective position and which can be easily realized.

To accomplish the above objects, according to the invention, the accelerating and decelerating periods of the trolley such as to eliminate the swing of suspended parcel are obtained on the basis of the mass of suspended parcel, mass of trolley to convey the parcel, and length of rope which suspends the parcel. When the trolley is started, a predetermined tractive force is applied to the trolley during the accelerating period, thereby allowing the velocity of trolley to become a desired velocity. When the trolley is stopped, a predetermined braking force is applied to the trolley during the decelerating period, thereby stopping the trolley.

In the case of determining the accelerating and decelerating periods of the trolley in consideration of the masses (weights) of suspended parcel and trolley as described above, even if the velocity of trolley varies due to the influence by the swing of suspended parcel during the accelerating and decelerating periods, the velocity of suspended parcel can be allowed to reach the objective operating velocity or can be stopped without causing any swing of parcel after those periods have elapsed. This is proved by the following expressions.

As shown in FIG. 1, in a crane in which a parcel of a mass m [kg] is suspended by a rope of a length l [m] and this parcel is transported by a trolley of a mass m [kg], a kinetic energy function A and a potential energy function U are obtained by the following expressions (1) and (2).

$$A = \tfrac{1}{2}M\dot{X}^2 + \tfrac{1}{2}\left[\left\{\frac{d}{dt}(X - l\sin\theta)\right\}^2 + \left\{\frac{d}{dt}(l\cdot\cos\theta)\right\}^2\right] \quad (1)$$

$$= \tfrac{1}{2}(m + M)\dot{X}^2 + \tfrac{1}{2}ml^2\dot{\theta}^2 - ml\dot{X}\dot{l}\cos\theta - \tfrac{1}{2}m\dot{l}^2 - m\dot{X}\dot{l}\sin\theta$$

$$U = -m\cdot g\cdot l\cdot\cos\theta \quad (2)$$

where,

X: Trolley position [m], $\dot{X}$: Trolley velocity [m/sec]

$\ddot{X}$: trolley acceleration [m/sec$^2$]
$\dot{l}$: Rope velocity [m/sec]
$\ddot{l}$: Rope acceleration [m/sec$^2$]
$\theta$: Swing angle [rad]
$\dot{\theta}$: Angular velocity [rad/sec]
$\ddot{\theta}$: Angular acceleration [rad/sec$^2$]
g: Gravity acceleration [9.81 m/sec$^2$]

Assuming that the standardized coordinates are set to $q=(x, l, \theta)'$ (where, "'" denotes a transposition symbol), the following expressions are satisfied with respect to the tractive force $F_x$ of trolley, hoisting force $F_l$ of rope, and swing of rope due to the Lagrange equation of motion.

$$\left.\begin{aligned} \frac{d}{dt}\left(\frac{\partial A}{\partial \dot{X}}\right) - \left(\frac{\partial A}{\partial X}\right) + \left(\frac{\partial U}{\partial X}\right) &= F_x \\ \frac{d}{dt}\left(\frac{\partial A}{\partial \dot{l}}\right) - \left(\frac{\partial A}{\partial l}\right) + \left(\frac{\partial U}{\partial l}\right) &= F_l \\ \frac{d}{dt}\left(\frac{\partial A}{\partial \dot{\theta}}\right) - \left(\frac{\partial A}{\partial \theta}\right) + \left(\frac{\partial U}{\partial \theta}\right) &= O \end{aligned}\right\} \quad (3)$$

From expressions (3), the following expressions are derived.

$$X = \frac{F_l}{M}\sin + \frac{F_x}{M} \quad (5)$$

$$\ddot{l} = \ddot{X}\sin\theta + l\cdot\dot{\theta}^2 + g\cdot\cos\theta + \frac{F_l}{m} \quad (6)$$

$$l\ddot{\theta} = \ddot{X}\cos\theta - 2\dot{l}\dot{\theta} - g\cdot\sin\theta \quad (7)$$

From expression (6), $$F_l = -m\ddot{X}\sin\theta - m\cdot l\dot{\theta}^2 - m\cdot g\cdot\cos\theta + m\cdot\ddot{l} \quad (8)$$

By substituting expression (5) for expression (8), we have $$\ddot{X} = -\frac{m}{M}\ddot{X}\sin^2\theta - \frac{m}{M}l\dot{\theta}^2\sin\theta - \frac{m}{M}g\cdot\cos\theta\sin\theta + \frac{m}{M}\ddot{l}\sin\theta + \frac{F_x}{M} \quad (9)$$

By multiplying each side of expression (7) with $(m/M)\cos\theta$ and then subtracting the resultant expression from expression (9), we have $$\ddot{X} - \frac{m}{M}l\ddot{\theta}\cos\theta = -\frac{m}{M}\ddot{X} - \frac{m}{M}l\dot{\theta}^2\sin\theta + 2\frac{m}{M}\dot{l}\dot{\theta}\cos\theta + \frac{m}{M}\ddot{l}\sin\theta + \frac{F_x}{M} \quad (10)$$

Thus, we have $$(M+m)\ddot{X} = m\cdot l\ddot{\theta}\cos\theta - m\cdot l\dot{\theta}^2\sin\theta + 2m\dot{l}\dot{\theta}\cos\theta + m\ddot{l}\sin\theta + F_x \quad (11)$$

Each side of expression (11) is multiplied with $\cos\theta/(m+M)$ to obtain the value of $\ddot{X}\cos\theta$, and this value is substituted for expression (7). Then, we have $$l\ddot{\theta} = \frac{m}{M+m}l\ddot{\theta}\cos^2\theta - \frac{m}{M+m}l\dot{\theta}^2\sin\theta\cos\theta + \frac{2m}{M+m}\dot{l}\dot{\theta}\cos + \frac{m}{M+m}\ddot{l}\sin\theta\cos\theta + \frac{F_x}{M+m}\cos\theta - 2\dot{l}\dot{\theta} - g\cdot\sin\theta \quad (12)$$

Therefore, it is now assumed that $\theta\approx 0$, $\sin\theta=0$, and $\cos\theta=1$, expression (12) is simplified, and the similar terms are rearranged. Then, we have $$\left(\frac{M}{M+m}\right)l\ddot{\theta} = -\frac{m}{M+m}l\dot{\theta}^2\theta - \frac{2M}{M+m}\dot{l}\dot{\theta} + \frac{m}{M+m}\ddot{l}\theta + \frac{F_x}{M+m} - g\theta \quad (13)$$

Thus, we have $$\ddot{\theta} = -\frac{m}{M}\dot{\theta}^2\theta - 2\dot{l}\dot{\theta} + \frac{m}{M}\frac{\ddot{l}}{l}\theta + \frac{F_x}{M\cdot l} - \frac{M+m}{M}\cdot\frac{g}{l}\theta \quad (14)$$

It is now assumed that a change in rope length l is small and the terms concerned with $\dot{l}$ and $\ddot{l}$ are set to 0, respectively, and $\dot{\theta}^2$ is set to 0. Thus, expression (14) becomes as follows.

$$\ddot{\theta} = \frac{F_x}{M\cdot l} - \frac{M+m}{M}\frac{g}{l}\theta \quad (15)$$

From expression (15), assuming that $F_x$ is constant, the period T of suspended parcel becomes $$T = 2\pi\sqrt{\frac{M}{M+m}\cdot\frac{l}{g}} \quad (16)$$

In the present invention, the accelerating period $T_1$ and decelerating period $T_2$ are determined from expression (16) on the basis of the mass m of suspended parcel to be transported, mass M of trolley, and length l of rope.

The foregoing and other objects, advantages, manner of operation, and features of the present invention will be understood from the following detailed description when read in connection with the accompanying drawings.

DESCRIPTION OF THE PREFERRED EMBODIMENT

Figure 2:
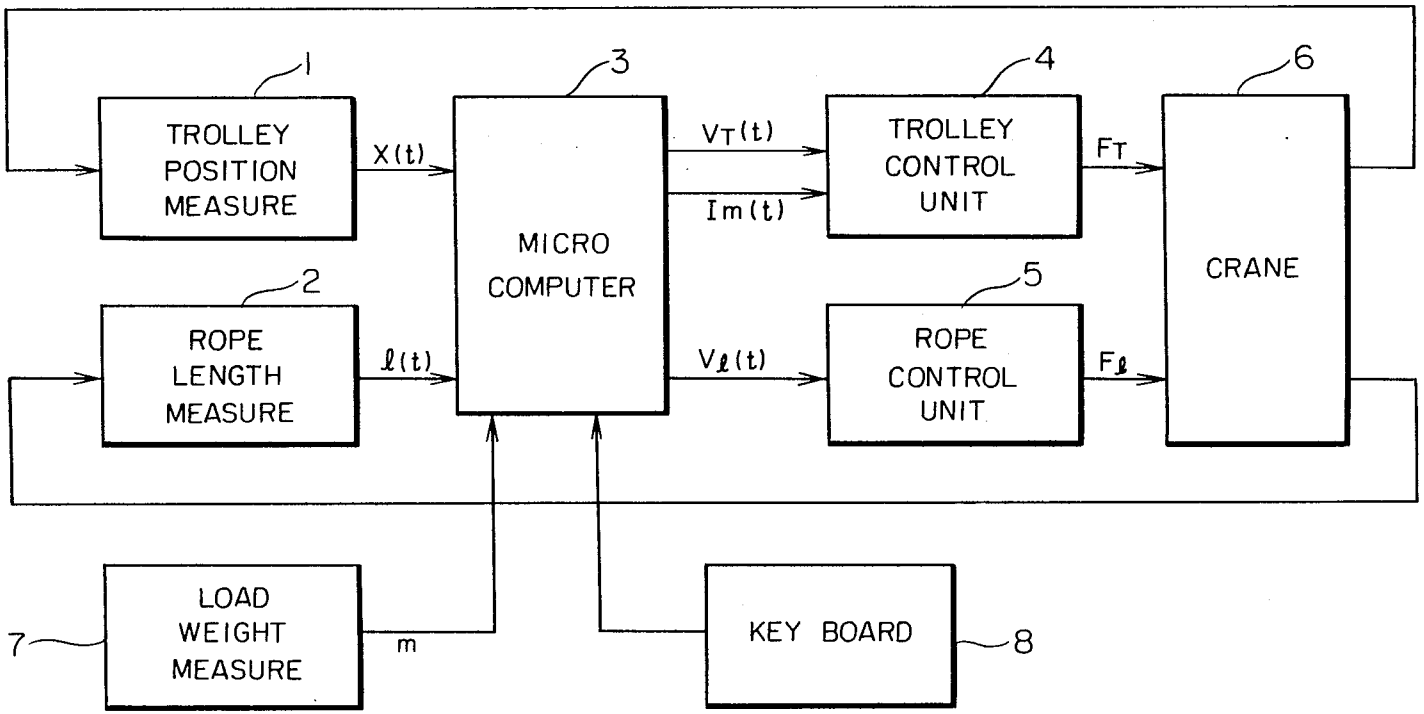
FIG. 2 is a block diagram of a crane control apparatus for embodying the invention.

FIG. 2 shows a block diagram of a crane control apparatus for embodying the present invention. In the diagram, reference numeral 1 denotes an apparatus for measuring the current position X(t) of a trolley 11; 2 is an apparatus for measuring the rope length l(t); 7 an apparatus for measuring the mass m of a suspended parcel 10; and 3 a microcomputer for calculating and outputting control commands including the objective velocity $V_T(t)$ of trolley, limit value $I_m(t)$ of accelerating/decelerating current of trolley tractive motor, and objective velocity $V_l(t)$ of rope on the basis of the respective measured values. A trolley control unit 4 receives the command values $V_T(t)$ and $I_m(t)$ and generates the tractive force $F_T$ of trolley. A rope control unit 5 receives the command value $V_l(t)$ and generates the hoisting force $F_l$ of rope. A crane 6 transports and hoists up and down the suspended parcel by the tractive and hoisting forces $F_T$ and $F_l$. Various kinds of parameters and control commands are input to the microcomputer 3 by a keyboard 8.

Figure 1:
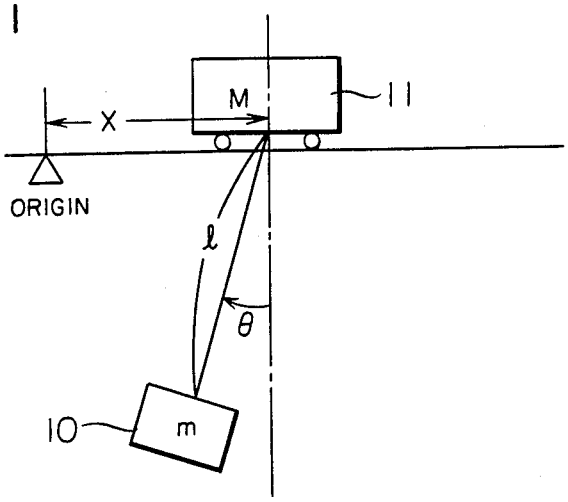
FIG. 1 is a diagram for explaining the principle of the crane control according to the present invention.
Figure 3:
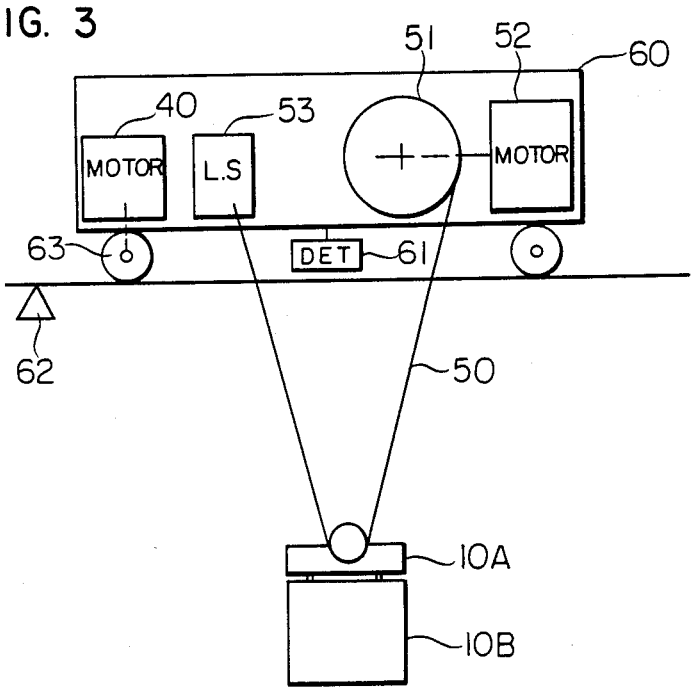
FIG. 3 is a diagram showing a constitution of a trolley.

FIG. 3 shows a trolley 60 as the main part of the crane. The trolley 60 is equipped with: a motor 40 constituting the trolley control unit 4; a hoist 51 for winding up a rope 50; a motor 52 for driving the hoist; a load cell 53 for detecting the mass m from the tension of rope; and a mark detector 61 for detecting a position mark 62 on the rail. The mass m is the sum of the weight of a parcel 10B such as, for example, a container and the like and the weight of a spreader 10A for supporting the parcel 10B.

The trolley position measuring apparatus 1 counts the pulses which are generated from a tachometer (not shown) which is interlocked with wheels 63 which are driven by the motor 40, thereby obtaining the current position X(t) on the basis of the travel distance of the trolley from the origin mark detected by the mark detector 61. Similarly, the rope length measuring apparatus 2 also counts the output pulses from the tachometer (not shown) which rotates interlockingly with the hoist 51, thereby obtaining the current rope length l(t).

Figure 4A:
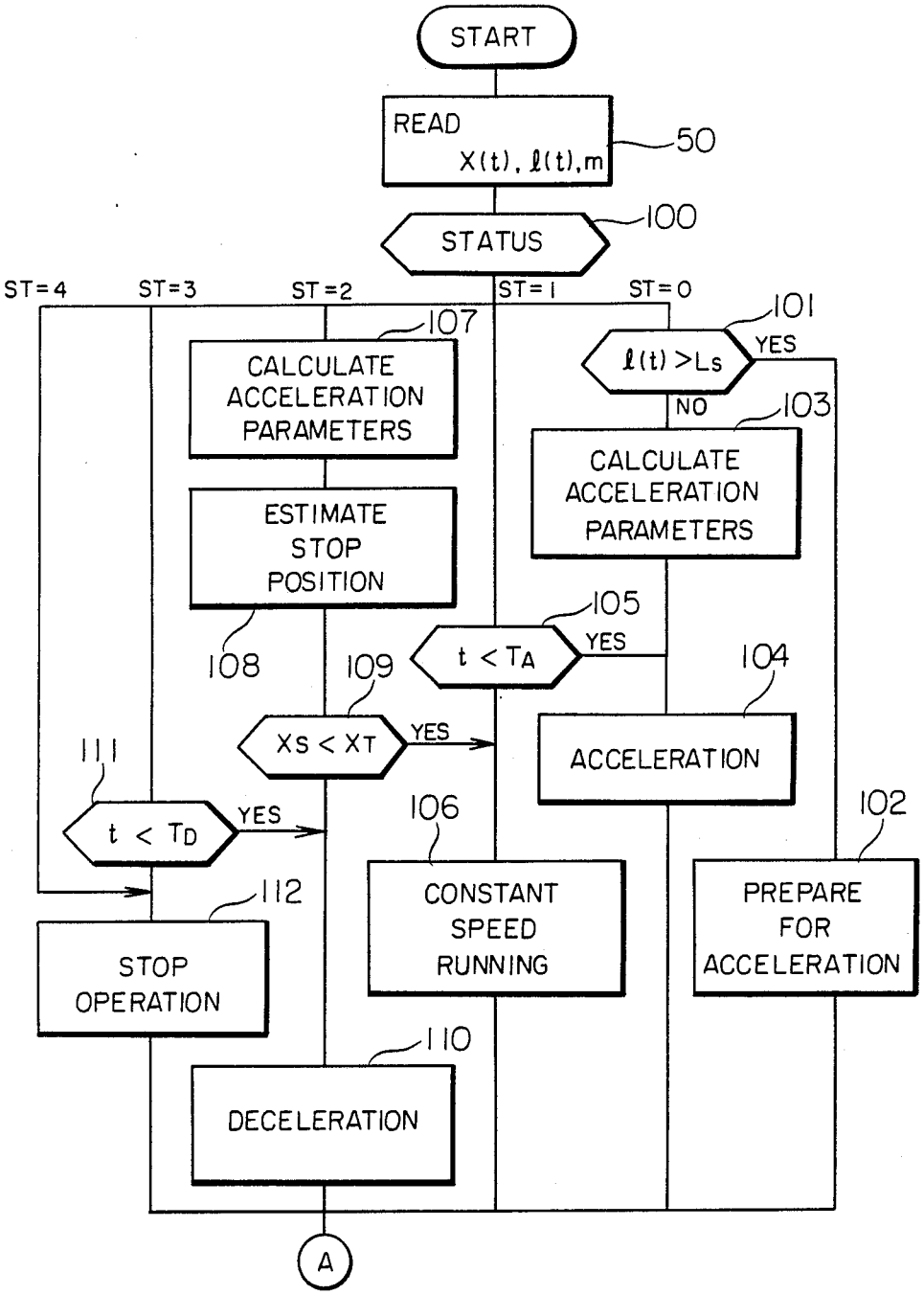
FIGS. 4A and 4B are flowcharts of control program for executing the crane control according to the invention.

The control program which is executed by the microcomputer to realize the crane control method of the invention will now be described hereinbelow with reference to FIGS. 4A and 4B. By depressing a start button arranged on the keyboard 8, the execution of the control program is started. Thereafter, this program is repeatedly executed at every constant period.

Figure 5:
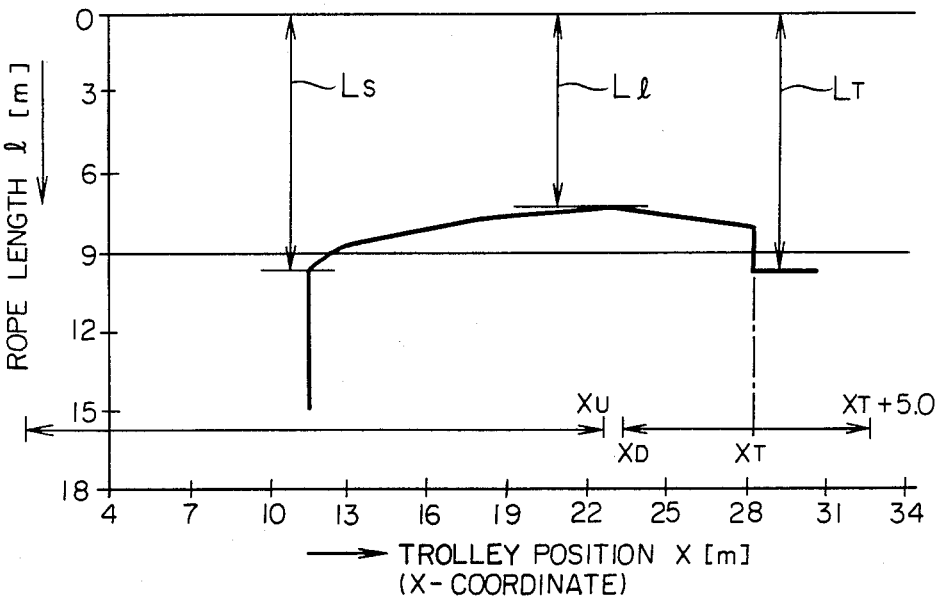
FIG. 5 is a diagram for explaining the control operation of the length of rope.

Prior to depressing the start button, various data indicative of the locus of rope length as shown in FIG. 5 is input from the keyboard 8: namely, the objective destination (position) $X_T$ of transportation of the parcel; rope length $L_S$ as the starting condition of the accelerating operation of the trolley; shortest rope length $L_l$ indicative of the limit value in the rope winding-up operation; last rope length $l_T$ indicative of the objective value in the rope putting-down operation at the objective position $X_T$; coordinate values (0 to $X_U$) indicative of the allowable region of the rope winding-up operation; and coordinate values ($X_D$ to $X_T+5.0$) representative of the allowable region of the rope putting-down operation. In addition, the status parameter ST indicative of the state of trolley is initialized to "0".

When the control program is started, the measured values X(t), l(t), and m which are obtained by the measuring apparatuses 1, 2, and 7 are first read in step 50. Then, the status parameter ST is discriminated (step 100) and the program sequence according to the state of trolley is selected.

When the status parameter ST is the initial value "0", the trolley is in the acceleration standby mode, so that the rope length l(t) is compared with $L_s$ in step 101. If l(t) is longer than $L_s$, the objective velocity $V_T$ of trolley is set to zero to stop the trolley (step 102). Then, the rope control sequence shown in FIG. 4B follows. When the rope length l(t), is $L_s$ or shorter, step 103 follows and the accelerating period of time $T_1$ and accelerating force $F_1$ are calculated by the following expressions as parameters for the accelerating operation.

$$T_1 = 2\pi\sqrt{\frac{M}{M+m}\cdot\frac{l(t)}{g}} \tag{21}$$

$$F_1 = (M+m)\cdot\bar{\alpha}_1 \tag{22}$$

where, $\alpha_1$ is a mean acceleration (m/sec$^2$) of trolley which is calculated by $V_c/T_1$. From the accelerating time $T_1$ obtained by expression (21) and current time t, the end time $T_A$ of the accelerating operation is calculated as follows.

$$T_A = t + T_1 \tag{23}$$

The acceleration current $I_{m1}$ which is supplied to the trolley tractive motor 40 is calculated as follows.

$$I_{m1} = F_1/K_M \tag{24}$$

$K_M$ is a proportional coefficient between the armature current and torque of the motor 40. In the next step 104, the parameter ST is set to "1" and the current value derived by expression (24) is output as the current command value $I_m(t)$ to accelerate the trolley. On the other hand, a positive large value which is, for example, about twice as large as the objective value $V_c$ of the constant speed operation is output as the objective velocity $V_T(t)$ of trolley in order to saturate the velocity controller in the trolley control unit 4, thereby allowing the constant acceleration torque control in the current limiting control state to be performed.

If the value of ST is "1" in step 100, step 105 follows and a check is made to see if the current time t has reached the acceleration end time $T_A$ or not. if NO in step 105, the trolley is continuously accelerated in step 104. If YES, the objective value $V_c$ of the constant speed operation is output as the trolley objective velocity $V_T(t)$ in step 106 and the status parameter ST is set to "2".

If the value of ST is "2" in step 100, step 107 follows and the decelerating time $T_2$, decelerating force $F_2$, end time $T_D$ of the decelerating operation, and, decelerating current $I_{m2}$ are calculated by the following expressions as the parameters for the decelerating operation.

$$T_2 = 2\pi\sqrt{\frac{M}{M+m}\cdot\frac{l(t)}{g}} \tag{25}$$

$$F_2 = (M+m)\cdot\alpha_2 \tag{26}$$

$$T_D = t + T_2 \tag{27}$$

$$T_{m2} = F_2/K_M \tag{28}$$

where, $\overline{\alpha_2}$ is a mean deceleration (m/sec$^2$) which is calculated by $V_c/T_2$.

In the next step 108, from the current position X(t) of the trolley, objective velocity $V_c$, and mean deceleration $\overline{\alpha_2}$, the prediction stop position $X_s$ in the case where the decelerating operation was started at that time is calculated as follows.

$$X_s = X(t) + \frac{V_c^2}{2\overline{\alpha_2}} \tag{29}$$

The prediction stop position $X_s$ is compared with the objective stop position $X_T$ in step 109. If the position $X_s$ is before the position $X_T$, the constant speed running is continued in step 106. If $X_s$ has reached $X_T$, the deceleration current $I_{m2}$ is output as the current command value $I_m(t)$ in step 110. In addition, a negative large value is output as the objective velocity V(t) of trolley contrarily to the case of the accelerating operation. Then, the status parameter ST of the trolley is set to "3".

If the value of ST is "3", step 111 follows after step 100 and a check is made to see if the current time t has reached the end time $T_D$ of the decelerating operation which was obtained in step 107 or not. If NO in step 111, the decelerating operation is continued in step 110. If YES, the objective velocity $V_T(t)$ of trolley is set to zero in step 112 and the status parameter ST is set to "4" indicative of the stop state of the trolley.

If the value of ST is "4" in step 100, step 112 to stop the trolley mentioned above is executed.

Figure 4B:
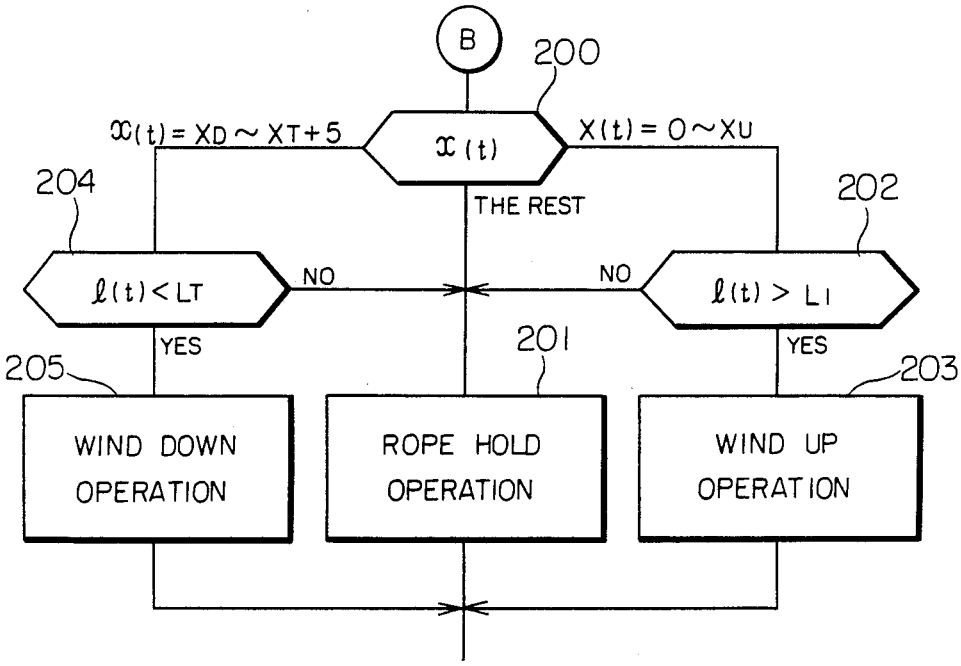

Subsequent to the running control sequence of the trolley, a control sequence of the rope shown in FIG. 4B is executed. In this sequence, the current position X(t) of the trolley is discriminated in step 200. If the trolley is located in the rope winding-up region ($0 \leqq X(t) \leqq X_u$), the current rope length l(t) is compared with the shortest rope length $L_1$ in step 202. If l(t) is longer than $L_1$, the winding-up command value, for example, 0.6 (m/sec) is given as the objective velocity $V_l(t)$ of the rope in step 203 and this routine is finished. If X(t) is located in the putting-down region ($X_D \leqq X(t) \leqq X_T + 5.0$) of the trolley, the current value l(t) of rope is compared with the last rope length $L_T$ in step 204. If l(t) is shorter than $L_T$, the putting-down command value, for example, −0.6 (m/sec) is given as the objective velocity $V_l(t)$ of rope in step 205. If X(t) is out of both of those regions, if l(t) has reached $L_1$ in the winding-up region, or if l(t) has reached $L_T$ in the putting-down region, the current rope length is maintained in step 201.

Although the mass m of parcel has been obtained from the measured value of the measuring apparatus 7 in the embodiment, if the value of mass m has previously been known, it may be also input by the keyboard 8.

On the other hand, the winding-up or putting-down operation of the rope has been executed in parallel during the running operation of the trolley in the embodiment. However, in the case of transporting the parcel to the objective destination with the rope length $L_s$ unchanged, the value of $T_2$ can be equalized with $T_1$.

Figures 6A, 6B, 6C, 6D:
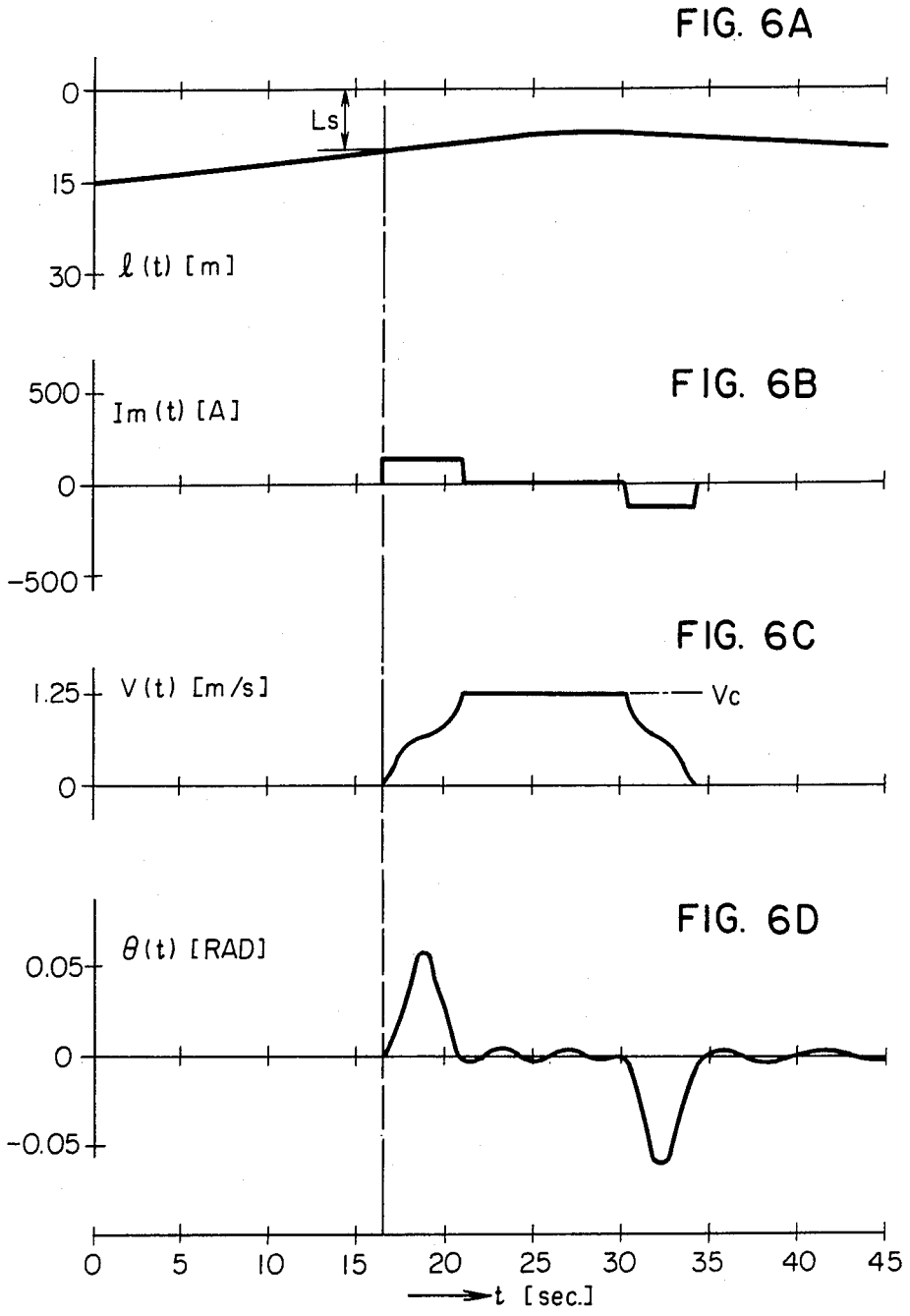
FIGS. 6A to 6D are diagrams showing time-dependent changes in rope length l(t), trolley tractive current $I_m(t)$, trolley velocity V(t), and rope swing angle $\theta(t)$ in the crane control of the invention, respectively.

FIGS. 6B to 6D show the results of simulation by the computer concerned with the crane control according to the present invention. FIG. 6A shows a change in rope length l(t). FIG. 6B shows a change in current command value $I_m(t)$ to the trolley controller. FIG. 6C shows a change in trolley velocity V(t). FIG. 6D shows a change in rope swing angle $\theta(t)$. In FIGS. 6A to 6D, an axis of abscissa denotes the time.

Figure 7:
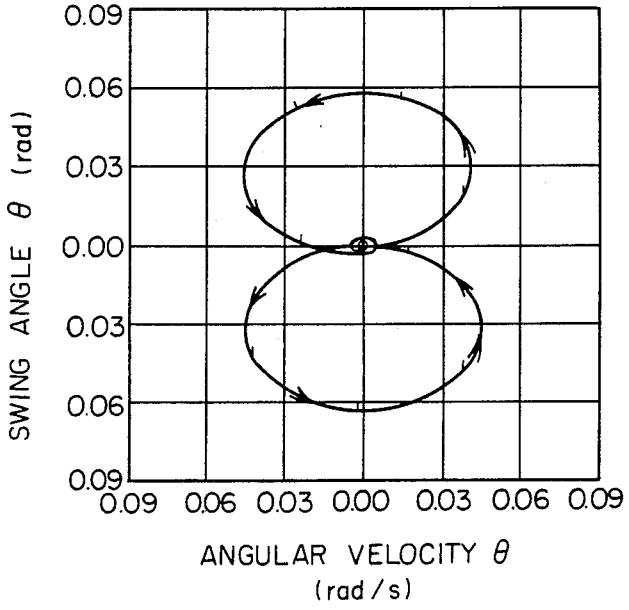
FIG. 7 is a phase plane diagram showing the relation between the rope swing angle $\theta$ and the rope swing angular velocity $\dot{\theta}$.

FIG. 7 is a graph in which the rope swing angle $\theta(t)$ is plotted as a plan view. In FIG. 7, an axis of abscissa denotes the swing angular velocity $\dot{\theta}$ and an axis of ordinate indicates the swing angle $\theta$. $\dot{\theta}$ is the time differential value (rad/sec) of the swing angle. In this example, it will be understood that the suspended parcel swings in the range of $\theta$0.06 to 0.06 rad within the velocity range of −0.045 to 0.045 rad/sec.

As will be obvious from the above description, in the present invention, the accelerating and decelerating times (periods) $T_1$ and $T_2$ of the trolley are obtained in consideration of not only the rope length but also the masses of suspended parcel and of trolley, and the periods $T_1$ and $T_2$ are reduced as the mass of suspended parcel increases. By changing the accelerating and decelerating periods of the trolley in accordance with the mass of suspended parcel in this manner, the parcel can be transported to the objective destination with less swing for a short time according to the present invention. On the other hand, during the operation of the trolley, by controlling the rope length in parallel therewith, the starting time of the trolley and the starting time to put down the parcel can be reduced, so that the time which is required to convey the parcel can be further reduced.

We claim:

1. A method of controlling a crane in which a parcel suspended by a rope is laterally transported by a trolley, comprising the steps of:

obtaining an accelerating time of the trolley on the basis of a mass of trolley, mass of suspended parcel including a suspending device, and a length of rope upon starting of the trolley;

obtaining an accelerating force of trolley necessary for allowing velocities of said trolley and suspended parcel to reach objective velocities for said accelerating time;

applying said accelerating force to the trolley for said accelerating time;

allowing the trolley to uniformly run at said objective velocity after said accelerating time has elapsed; and winding up the rope while measuring the rope length and in which when said rope length becomes a first objective value, said trolley is started, and after the trolley was made operative, the rope is continuously wound up until the rope length becomes a second objective value.

2. A method of controlling a crane in which a parcel suspended by a rope is laterally transported by a trolley, comprising the steps of:

obtaining an accelerating time of the trolley on the basis of a mass of trolley, mass of suspended parcel including a suspending device, and a length of rope upon starting of the trolley;

obtaining an accelerating force of trolley necessary for allowing velocities of said trolley and suspended parcel to reach objective velocities for said accelerating time;

applying said accelerating force to the trolley for said accelerating time;

allowing the trolley to uniformly run at said objective velocity after said accelerating time has elapsed; and wherein said accelerating time $T_1$ of the trolley is calculated on the basis of the following expression:

$$T_1 = 2\pi\sqrt{\frac{M}{M+m}\cdot\frac{N(t)}{g}}$$

where, M is a mass of trolley, m is a mass of suspended parcel, g is gravity, and l(t) is a rope length.

3. A method of controlling a crane in which a parcel suspended by a rope is laterally transported by a trolley, comprising the steps of:

obtaining an accelerating time of the trolley on the basis of a mass of trolley, mass of suspended parcel including a suspending device, and a length of rope upon starting of the trolley;

obtaining an accelerating force of trolley necessary for allowing velocities of said trolley and suspended parcel to reach objective velocities for said accelerating time;

applying said accelerating force to the trolley for said accelerating time;

allowing the trolley to uniformly run at said objective velocity after said accelerating time has elapsed;

obtaining a decelerating time of the trolley on the basis of the mass of trolley, mass of suspended parcel, and current rope length of the trolley;

obtaining a decelerating force of the trolley necessary to step the trolley and suspended parcel from said objective velocities for said decelerating time;

applying said decelerating force to the trolley for said decelerating time; and after the trolley has passed a predetermined position, putting down the rope in parallel with the running of the trolley until the rope length becomes a third objective value.

4. A method of controlling a crane in which a parcel suspended by a rope is laterally transported by a trolley, comprising the steps of:

obtaining an accelerating time of the trolley on the basis of a mass of trolley, mass of suspended parcel including a suspending device, and a length of rope upon starting of the trolley;

obtaining an accelerating force of trolley necessary for allowing velocities of said trolley and suspended parcel to reach objective velocities for said accelerating time;

applying said accelerating force to the trolley for said accelerating time;

allowing the trolley to uniformly run at said objective velocity after said accelerating time has elapsed;

obtaining a decelerating time of the trolley on the basis of the mass of trolley, mass of suspended parcel, and current rope length of the trolley;

obtaining a decelerating force of the trolley necessary to step the trolley and suspended parcel from said objective velocities for said decelerating time;

applying said decelerating force to the trolley for said decelerating time; and wherein the decelerating time $T_2$ of the trolley is calculated on the basis of the following expression:

$$T_2 = 2\pi\sqrt{\frac{M}{M+m}\cdot\frac{N(t)}{g}}$$

where, M is a mass of trolley, m is a mass of suspended parcel, g is gravity and l(t) is a rope length.

* * * * *